US011976388B2

(12) United States Patent
Wolfer et al.

(10) Patent No.: US 11,976,388 B2
(45) Date of Patent: May 7, 2024

(54) RECORDING OF TRASH IN A FIBER PREPARATION SYSTEM

(71) Applicant: Maschinenfabrik Rieter AG, Winterthur (CH)

(72) Inventors: Tobias Wolfer, Altnau (CH); Petr Cevona, Usti nad Orlici (CZ); Pavel Stejskal, Dolni Dobrouc (CZ)

(73) Assignee: Maschinenfabrik Rieter AG, Winterthur (CH)

( * ) Notice: Subject to any disclaimer, the term of this patent is extended or adjusted under 35 U.S.C. 154(b) by 357 days.

(21) Appl. No.: 17/393,518

(22) Filed: Aug. 4, 2021

(65) Prior Publication Data

US 2022/0042213 A1 Feb. 10, 2022

(30) Foreign Application Priority Data

Aug. 5, 2020 (CH) ..... 00975/20

(51) Int. Cl.
*D01G 31/00* (2006.01)
*D01G 7/00* (2006.01)
*D01G 9/08* (2006.01)

(52) U.S. Cl.
CPC ..... *D01G 31/003* (2013.01); *D01G 7/00* (2013.01); *D01G 9/08* (2013.01)

(58) Field of Classification Search
None
See application file for complete search history.

(56) References Cited

U.S. PATENT DOCUMENTS 5,321,496 A * 6/1994 Shofner ..... G01N 15/06 19/200
5,430,301 A * 7/1995 Shofner ..... D01G 31/003 356/238.2
5,791,489 A * 8/1998 Leifeld ..... D01B 3/025 209/567
2014/0053949 A1* 2/2014 Witt ..... B65B 37/10 141/83

FOREIGN PATENT DOCUMENTS

CH 697 063 A5 4/2008
CN 210 458 457 U 5/2020
(Continued)

OTHER PUBLICATIONS

Swiss Search Report, dated Nov. 4, 2020.

*Primary Examiner* — Jacob S. Scott
*Assistant Examiner* — Miraj T. Patel
(74) *Attorney, Agent, or Firm* — Dority & Manning, P.A.

(57) ABSTRACT

A method and associated device and system are provided for recording trash in a fiber preparation system having a plurality of cleaning points and a transport line that is connected to the cleaning points and is guided into a central container connected to a negative pressure source for generating transport air. The trash is suctioned from each cleaning point through the transport line with the transport air to the central container and is feed separately from each cleaning point to the central container. In the central container, the trash is separated from the transport air and transferred into a scale for weighing. With the trash located on the scale, an optical recording of the trash is made with a camera directed to an interior of the scale.

7 Claims, 2 Drawing Sheets

(56) References Cited

FOREIGN PATENT DOCUMENTS

| | | | |
|---|---|---|---|
| DE | 40 33 427 | A1 | 4/1992 |
| DE | 100 63 861 | | 6/2002 |
| EP | 0 399 315 | | 11/1990 |
| EP | 0 408 491 | A1 | 1/1991 |
| EP | 2 045 378 | A1 | 4/2009 |
| WO | WO 96/11292 | A2 | 4/1996 |

* cited by examiner

RECORDING OF TRASH IN A FIBER PREPARATION SYSTEM

FIELD OF THE INVENTION

The invention relates to a method for recording trash in a fiber preparation system.

BACKGROUND

In a fiber preparation system in a spinning mill, supplied fibers or fiber flocks are prepared for use in a spinning machine. In a fiber preparation system, the fibers to be prepared for spinning pass through a plurality of processing stages. In a first stage, the fibers are removed from fiber bales in the form of fiber flocks. So-called bale openers are usually used for this purpose. These fiber flocks are transported out of the bale opener by means of pneumatic fiber flock conveyance and are, for example, transferred to a downstream cleaning machine. In the further stages, the fiber preparation system also has a sequence of cleaning machines through which the fibers or fiber flocks pass. The sequence and design of the cleaning machines are adapted to the fibers to be processed and are used for cleaning, mixing, and separating the fiber flocks into individual fibers and making them parallel. The individual cleaning machines in a fiber preparation system can be arranged in different ways, this being dependent, inter alia, on the raw material to be processed and the product to be obtained.

The cleaning machines used are, for example, coarse cleaners, fine cleaners, foreign part separators and carders or cards. Other types of machines, such as stores or mixers, can also be equipped with cleaning modules, which are also to be included in the cleaning machines. The individual points in a machine, at which a waste product from the cleaning process, the so-called trash, is produced are correspondingly referred to as cleaning points. A single cleaning machine can thus have a plurality of cleaning points, for example, the trash of a licker-in can be removed separately from the trash of a revolving flat unit in a carder. Conversely, however, the trash that is produced at different points in the machine can also be combined within the machine. In the following description, any point of a machine from which a separate connection is provided to a subsequent trash removal is therefore referred to as a cleaning point.

The fibers or fiber flocks are usually conveyed between the machines by a pneumatic transport system using transport air. Upstream of the cleaning machines, the transport air is discharged as necessary by a separate exhaust air system. In the cleaning machine or cleaning point itself, so-called trash is produced, which includes the dirt particles, foreign parts, seed parts or stalk parts, dust particles or short fibers or fiber knots, referred to as neps, which are separated from the fibers or fiber flocks in the cleaning process. Due to the design of the cleaning points, good fibers, i.e. fibers that could actually be processed in the subsequent spinning mill, also get into the trash. The proportion of good fibers in the trash of a cleaning point should be kept as low as possible. However, it cannot be completely prevented that, as a result of the cleaning of the fiber material, good fibers are also separated from the fiber material and become part of the trash. The more intensively the fiber material is to be cleaned, the higher the proportion of good fibers in the trash. If the cleaning point is adjusted such that a small proportion of good fibers is produced, the fiber material is cleaned to a lesser extent.

Carders, which separate the fiber flocks into individual fibers and form them into a sliver, often form the end of the fiber preparation system. Downstream of the carders, the fibers are passed on to the spinning preparation process in the form of slivers. In the spinning preparation process, the slivers are processed by draw frames, combing machines or flyers for use in final spinning processes.

Various approaches for monitoring the trash in the individual cleaning machines are known from the prior art. For example, CH 697 063 A5 discloses a device on a spinning preparation machine for recording waste (trash) consisting of foreign substances and good fibers. The waste is collected in a collecting device in the machine and guided past a brightness sensor. The proportion of good fibers is detected by the brightness sensor and the cleaning device of the machine in question is set to minimize the proportion of good fibers in accordance with the specifications. EP 0 399 315, by contrast, discloses a sensor that detects the proportion of dirt in the collecting container for the trash of a cleaning machine and makes it possible to maximize the proportion of dirt. The disadvantage of these devices is that they have to be provided individually for each machine and, as a result, the cleaning performance of each machine is also evaluated independently.

The process of sampling is also known from the prior art. In this case, a sample of the trash is periodically taken from the individual cleaning points and examined on appropriate laboratory machines. The disadvantage of this is that this procedure is time-consuming and the results of the analysis are available with a time delay.

SUMMARY OF THE INVENTION

The problem addressed by the invention is therefore that of providing a device that makes it possible for the trash to be recorded centrally, as a result of which the trash can be recorded for subsequent analysis, which provides the possibility of optimizing the operation of the entire fiber preparation system as well as of the individual cleaning points.

Additional objects and advantages of the invention will be set forth in part in the following description, or may be obvious from the description, or may be learned through practice of the invention.

The problems are solved by a method and a device having the features described and claimed herein.

In order to solve the problem, a novel method for recording trash in a fiber preparation system having a plurality of cleaning points and a transport line that is connected to the cleaning points and is guided into a central container is used. The central container is connected to a negative pressure source for generating transport air and the trash is suctioned from each cleaning point through the transport line with the transport air to the central container. In the central container, the trash is separated from the transport air and transferred into a scale and weighed. The trash located in the scale is optically recorded by a camera directed to an interior of the scale. Because a central recording and analysis of the trash of all cleaning points of a fiber preparation system takes place, the processes on the individual machines can be simpler and also more cost-effective. The negative pressure source can be designed as a fan or can also consist of a connection to a superordinate suction system of the fiber preparation system. The separation of the trash from the transport air is carried out using means known from the prior art, such as cyclones or filter systems. The weighing and optical recording of the trash is carried out as a snapshot after the trash has arrived in the central container from a cleaning point. It is practical for the weighing and optical recording to be postponed until the separation of trash and transport air has been completed. The camera suitable for optical image acquisition can be an RGB camera or a simple light-dark CCD camera. The choice of camera with regard to its resolution and sensitivity has to be made on the basis of the subsequent evaluation. If only the brightness is to be assessed, a b/w image acquisition having a low resolution is sufficient. However, if the individual dirt particles are to be recognized and assigned to certain categories, either a high-resolution camera is to be used or a high frame rate is necessary.

The trash of each cleaning point is fed separately to the central container. For this purpose, the connections between the cleaning points and the transport line can be closed individually. By means of a controller, the trash collection containers of the individual cleaning points can thus be emptied individually and as required, and the relevant trash can be supplied for recording. It is advantageous if, after the trash has been weighed and optically recorded, the scale is emptied into a waste container via a flap located in the bottom of the scale. This purely mechanical emptying of the central container prevents the need for a fluidic separation between the inlet and the outlet of the central container. The waste container can in turn be emptied by suction or replaced by an empty waste container.

A quality characteristic of the trash is preferably determined by evaluating the optical image acquisition. A generated image can be evaluated, for example, by determining the brightness or the ratio of light to dark. In the case of a high proportion of dirt or rubbish in the trash, the trash appears darker than in the case of a high proportion of good fibers in the trash. The quality characteristic can then be expressed, for example, as a percentage of good fibers or can be given a simple number that is assigned according to a predetermined scale. The quality characteristic can in this case be determined specifically for a cleaning point, since the good fiber content is important at one cleaning point, for example, but at another cleaning point the proportion of dust particles in the dirt is important. In this case, the quality characteristic can be output as a code that is then advantageously used to optimize a setting of the corresponding cleaning point. For this purpose, data sets are stored in the controller which contain the desired quality characteristics based on the specifications made by the operator or a selected process based on the product to be processed. If the quality characteristics from the analysis deviate from the specifications, the controller will output a message or, if the fiber preparation system and the individual machines are appropriately equipped, automatically correct the setting of the corresponding cleaning point. In an automated fiber preparation system, by evaluating the quality characteristics of individual cleaning points, the controller can also conclude that a change in the operating mode of machines influencing the trash at the analyzed cleaning point, rather than a change in the setting of a cleaning point, would have a greater effect.

Particularly preferably, not only the proportion of good fibers in the trash but also the distribution of the dirt particles according to type and size can be determined by the evaluation. The quality feature is calculated from the data, which quality feature contains a statement regarding the proportion of good fibers and the composition of the dirt particles.

In a further development, an image generated by optical image acquisition is analyzed using a neural network. Neural networks are able to evaluate large amounts of unstructured data, for example images, particularly well and to find patterns in said data. A neuron is a mathematical formula that processes an input and generates an output therefrom. The values of the formula are in this case defined by the output data. Many artificial neurons work together and thus form an artificial neural network. In order for neural networks to function, they need data that they know the result of in order to learn from said data; this process is referred to as training. Existing images are manually evaluated and the result is provided to the network. The network then performs a calculation and checks whether it matches the expected result. The neural network takes an image, breaks the individual pixels down into data (for example a color value) and then uses this data in a complex formula to calculate a result that it then compares with the result of the manual evaluation. If the result of the formula and the manual evaluation match, the network has correctly recognized an image. If the result of the formula and the manual evaluation do not match, the calculation is not yet correct and training must be continued.

A neural network does not solve this calculation using knowledge, but by means of trial and error—it optimizes the individual values in the neurons until the actual result corresponds to the desired result. Thousands of parameters are usually adjusted simultaneously in many very small steps. These steps are then repeated many thousands to millions of times, and not just with one image, but with many different images. The neuron values change a little each time. At the end of this process, however, the neurons are so fit that they can distinguish good fibers from trash in images. As a result, the neural network can not only differentiate between images that it already knows and has learned to classify correctly, it can also do this with images that it has never seen before. The network has abstracted a general pattern from the training images, which it can now apply to new images.

A device is also proposed for recording trash in a fiber preparation system having a plurality of cleaning points, a transport line that is connected to the cleaning points and is guided into a central container and a negative pressure source for generating transport air. The central container has a transport air separator and a scale and is provided with a camera directed into an interior of the scale for optically recording the trash located in the scale. The connection between a cleaning point and the transport line is provided with a shut-off element in each case. This makes it possible to transport trash from a single cleaning point and prevents a mixing of the trash and thus an inaccurate assessment of the efficiency of the individual cleaning points.

A bottom of the scale is preferably designed as a flap. After the trash located in the central container has been weighed and optically recorded, it can be disposed of into a waste container simply and without residue by means of the flap. Alternatively, the trash could also be suctioned out of the central container.

In a further development of the invention, a fiber preparation system having a device according to the previous description is proposed, the fiber preparation system comprising an optical image acquisition of a fiber material entering the fiber preparation system and an evaluation of the optical image acquisition in order to calculate a quality characteristic of the fiber material, and this quality characteristic being provided for the basic setting of the cleaning points. The fiber material typically enters a fiber preparation system in the form of fiber bales. The fiber bales are usually taken apart by so-called bale openers, and the fiber material is supplied in the form of fiber flocks for further processing in the fiber preparation system. By means of the optical image acquisition of the fiber bales and the subsequent analysis of the images, the arrangement, setting and mode of operation of the individual machines of the fiber preparation system can be checked or optimized on the basis of the calculated quality characteristics of the fiber material. This process makes it possible for the machines to be adjusted to a fiber material that is to be expected.

BRIEF DESCRIPTION OF THE DRAWINGS

The invention is described below with reference to an exemplary embodiment and explained in more detail by means of the drawings, in which.

DETAILED DESCRIPTION

Figure 1:
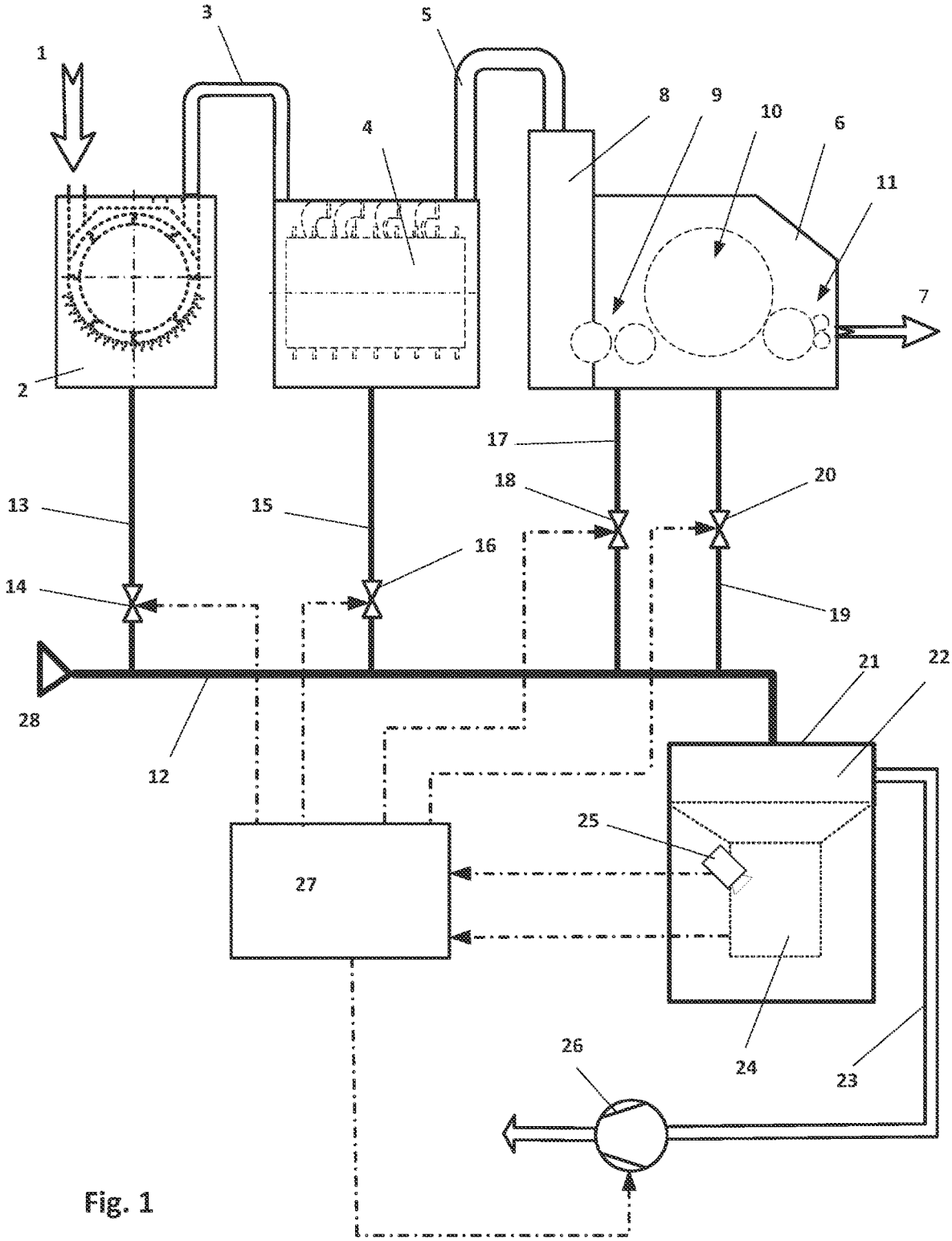
FIG. 1 is a schematic view of a fiber preparation system having a device according to the invention.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 is a schematic view of a fiber preparation system having a device according to the invention. Fibers or fiber flocks to be processed are fed into a coarse cleaner 2 via a fiber feed 1 (not shown in detail). The fibers pass from the coarse cleaner 2 to the fine cleaner 4 via a conveying line 3, and pass from said fine cleaner 4 to a carder 6 via a further conveying line 5. After the fibers or the fiber flocks have been guided through the various cleaning and processing stages, they leave the carder 6 in the form of a sliver 7 for further processing. In the embodiment shown, a cleaning point is provided in each case on the coarse cleaner 2 and the fine cleaner 4. The carder 6 in which the fibers are introduced via a filling chute 8 and then undergo coarse cleaning in a licker-in 9 and are transferred to a drum 10. At the circumference of the drum 10, the fibers are further cleaned and parallelized and then pass via a doffer into a sliver-forming unit 11, by means of which the fibers are formed into a sliver 7. In the embodiment shown, the carder 6 has a cleaning point on the licker-in 9 and a further cleaning point on the drum 10.

The cleaning points are individually connected to a transport line 12, which is used to remove trash which is produced in the cleaning points. The cleaning point of the coarse cleaner 2 is thus connected to the transport line 12 via the connection 13, a shut-off element 14 being provided in the connection 13. The connection 13 can be closed by the shut-off element 14 and the cleaning point of the coarse cleaner 2 can thus be decoupled from the transport line 12. Furthermore, the cleaning point of the fine cleaner 4 is connected to the transport line 12 via the connection 15, a shut-off element 16 being provided in the connection 15. Furthermore, the cleaning point of the licker-in 9 of the carder 6 is connected to the transport line 12 via the connection 17, a shut-off element 18 being provided in the connection 17. Furthermore, the cleaning point of the drum 10 of the carder 6 is connected to the transport line 12 via the connection 19, a shut-off element 20 being provided in the connection 19.

The transport line 12 is connected to a central container 21 and has an air inlet opening at the end thereof that is opposite the central container. The transport line 12 is connected to a negative pressure source 26, a fan in the embodiment shown, via the central container. The fan generates the transport air required to suction the trash away at the various cleaning points.

The central container 21 comprises a transport air separator 22, a scale and a camera 25 directed to the interior of the scale 24. The scale 24 and the camera 25 as well as the fan 26 and the shut-off elements 14, 16, 18 and 20 are connected to a controller 27. A transfer of the trash from a cleaning point is initiated by the controller 21. For this purpose, the shut-off element 14 in the connection 13 of the cleaning point of the coarse cleaner 2 is opened and the fan 26 is switched on, for example. The trash of the coarse cleaner 2 is thus suctioned through the transport line 12 into the central container 21, freed from the transport air and filled into the scale 24. The process of filling the scale 24 is completed by closing the shut-off element 14. The trash is then weighed and optically recorded by the camera 25. The various cleaning points are emptied successively in this way, and the trash suctioned away therefrom is fed to the central container 21. After the trash has been weighed and visually recorded, the controller carries out an analysis of the trash.

Figure 2:
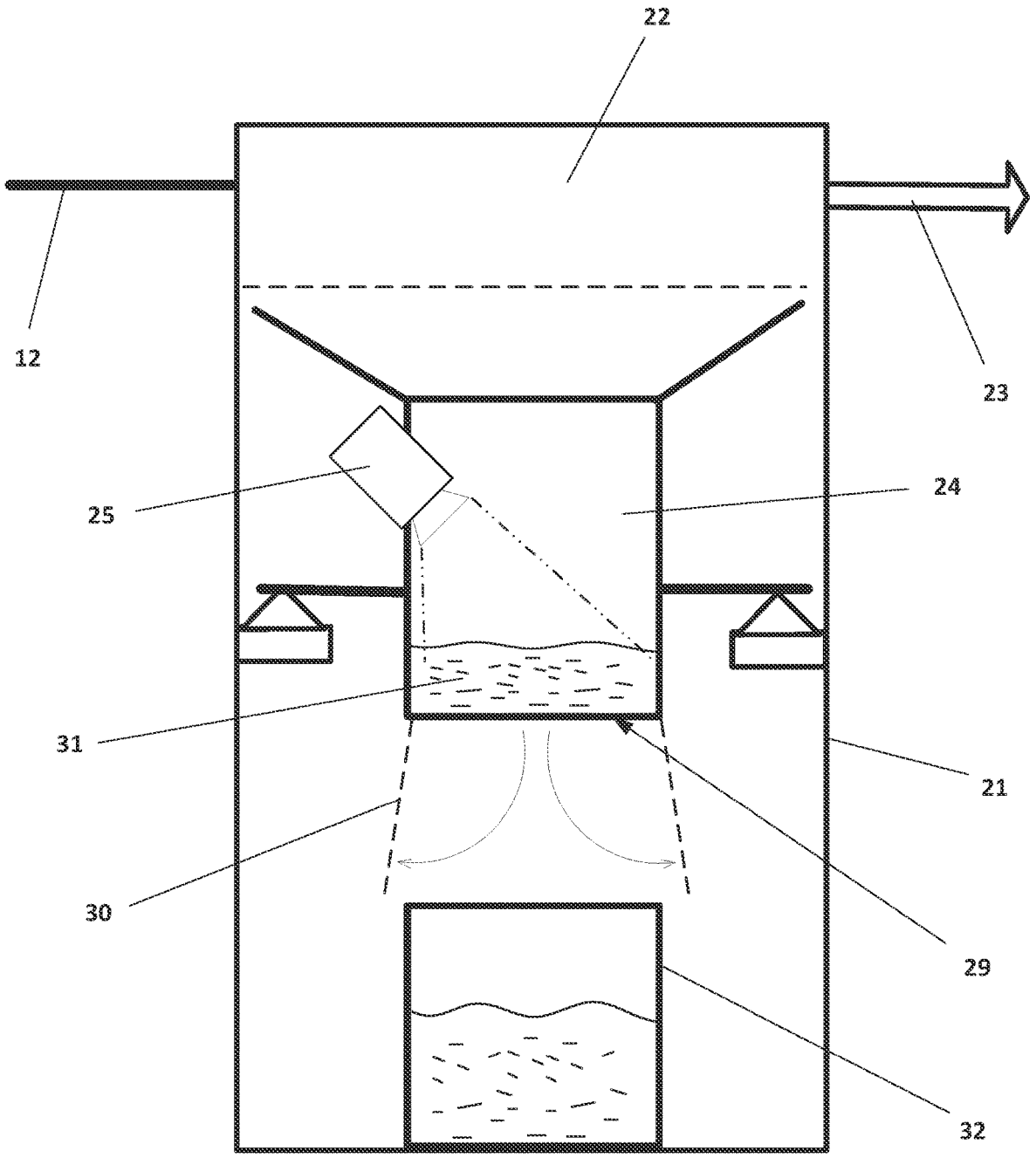
FIG. 2 is a schematic view of a central container for recording the trash according to the invention.

FIG. 2 is a schematic view of a central container 21 for recording the trash 31 according to the invention. The trash 31, together with the transport air 23, passes into the transport air separator 22 via the transport line 12. The transport air 23 is separated from the trash 31 by the transport air separator 22, the trash 31 passes into the scale 24, and the transport air 23 is discharged using the negative pressure source (not shown). The trash 31 is then weighed and optically recorded by a camera 25. The bottom 29 of the scale 24 is designed as a flap 30. After the trash 31 has been weighed and optically recorded, the flap 30 is opened and the contents of the scale 24 are emptied into a waste container 32. After the flap 30 is closed again, the trash of a further cleaning point can be brought into the central container 21.

The present invention is not limited to the embodiments shown and described. Modifications within the scope of the claims are possible, as is a combination of the features, even if these are shown and described in different embodiments.

LIST OF REFERENCE SIGNS

1 Fiber feed
2 Coarse cleaner
3 Conveying line
4 Fine cleaner
5 Conveying line
6 Carder
7 Sliver
8 Filling chute
9 Licker-in
10 Drum
11 Sliver-forming unit
12 Transport line
13, 15, 17, 19 Connection
14, 16, 18, 20 Shut-off element
21 Central container
22 Transport air separator
23 Transport air
24 Scale
25 Camera
26 Negative pressure source

27 Controller
28 Air inlet opening
29 Bottom of the scale
30 Flap
31 Trash
32 Waste container

The invention claimed is:

1. A method for recording trash in a fiber preparation system used in a spinning mill to prepare fibers or fiber flocks from fiber bales for subsequent spinning, the fiber preparation system having a plurality of cleaning points and a transport line that is connected to the cleaning points and is guided into a central container, the central container connected to a negative pressure source for generating transport air, the method comprising:

suctioning the trash from each cleaning point through the transport line with the transport air to the central container;

separately feeding the trash from each cleaning point to the central container;

in the central container, separating the trash from the transport air and transferring the trash into a scale and weighing the trash; and with the trash located on the scale, optically recording the trash with a camera directed to an interior of the scale.

2. The method according to claim 1, wherein after the trash has been weighed and optically recorded, the method further comprising emptying the trash from the scale into a waste via a flap located in a bottom of the scale.

3. The method according to claim 1, further comprising determining a quality characteristic of the trash by evaluating an optical image from the optically recording process.

4. A method for recording trash in a fiber preparation system having a plurality of cleaning points and a transport line that is connected to the cleaning points and is guided into a central container, the central container connected to a negative pressure source for generating transport air, the method comprising:

suctioning the trash from each cleaning point through the transport line with the transport air to the central container;

separately feeding the trash from each cleaning point to the central container;

in the central container, separating the trash from the transport air and transferring the trash into a scale and weighing trash;

with the trash located on the scale, optically recording the trash with a camera directed to an interior of the scale;

determining a quality characteristic of the trash by evaluating an optical image from the optically recording process; and further comprising using the quality characteristic to optimize a setting of the cleaning point corresponding to where the trash was collected.

5. A device for recording trash in a fiber preparation system used in a spinning mill to prepare fibers or fiber flocks from fiber bales for subsequent spinning, the fiber preparation system having a plurality of cleaning points, the device comprising:

a transport line connected to the cleaning points and guided into a central container;

a negative pressure source for generating transport air;

a separate connection of each of the cleaning points to the transport line, the connection comprising a separate shut-off element for each respective cleaning point;

the central container comprising a transport air separator and a scale; and the central container comprising a camera directed into an interior of the scale to optically record the trash located in the scale.

6. The device according to claim 5, wherein the scale comprises a bottom, the bottom comprising a flap for emptying the trash from the central container.

7. A fiber preparation system having a plurality of cleaning points, comprising:

a device for recording trash, the device comprising:

a transport line connected to the cleaning points and guided into a central container;

a negative pressure source for generating transport air;

a connection of each of the cleaning points to the transport line, the connection comprising a shut-off element;

the central container comprising a transport air separator and a scale; and the central container comprising a camera directed into an interior of the scale to optically record the trash located in the scale;

a controller, the controller configured:

to evaluate an optical image of fiber material entering the fiber preparation system and calculate a quality characteristic of the fiber material; and use the quality characteristic as a basis for adjustment of the cleaning points.

* * * * *